US007520224B2

(12) United States Patent
Taylor

(10) Patent No.: US 7,520,224 B2
(45) Date of Patent: Apr. 21, 2009

(54) ADVANCED ARMOR-PIERCING PROJECTILE CONSTRUCTION AND METHOD

(75) Inventor: John D. Taylor, 15440 Pompeii Sq., Colorado Springs, CO (US) 80921

(73) Assignee: John D. Taylor, Colorado Springs, CO (US)

( * ) Notice: Subject to any disclaimer, the term of this patent is extended or adjusted under 35 U.S.C. 154(b) by 40 days.

(21) Appl. No.: 11/482,250

(22) Filed: Aug. 18, 2006

(65) Prior Publication Data

US 2008/0092767 A1 Apr. 24, 2008

Related U.S. Application Data

(60) Provisional application No. 60/789,834, filed on Apr. 6, 2006.

(51) Int. Cl.
*F42B 12/04* (2006.01)
*F42B 10/02* (2006.01)

(52) U.S. Cl. ..... 102/518; 102/473; 102/501; 102/514; 102/517; 86/51; 86/52

(58) Field of Classification Search ..... 102/473, 102/517, 518, 514, 501; 86/51, 52
See application file for complete search history.

(56) References Cited

U.S. PATENT DOCUMENTS 3,782,287 A * 1/1974 Sie ..... 102/516
3,861,311 A * 1/1975 Bilsbury ..... 102/515
4,044,679 A * 8/1977 Pagano et al. ..... 102/517
4,108,073 A * 8/1978 Davis ..... 102/518
4,353,302 A * 10/1982 Strandli et al. ..... 102/364
4,612,860 A * 9/1986 Flatau ..... 102/518
4,619,203 A * 10/1986 Habbe ..... 102/516
4,625,650 A * 12/1986 Bilsbury ..... 102/516
5,009,166 A * 4/1991 Bilsbury et al. ..... 102/516
5,020,439 A * 6/1991 Winter et al. ..... 102/518
5,163,166 A * 11/1992 Adler et al. ..... 102/492
5,175,392 A * 12/1992 Denis ..... 102/364
H1235 H * 10/1993 Canaday ..... 102/334
5,325,787 A * 7/1994 Boual ..... 102/506
5,445,079 A * 8/1995 Boual ..... 102/506
6,026,750 A * 2/2000 Nelson ..... 102/476
6,085,661 A * 7/2000 Halverson et al. ..... 102/516
6,223,656 B1 * 5/2001 Glenn ..... 102/306

(Continued)

*Primary Examiner*—James S Bergin
*Assistant Examiner*—Michael D David
(74) *Attorney, Agent, or Firm*—Dale B. Halling

(57) ABSTRACT

A firearm projectile includes a precision-machined outer component having a generally cylindrical body, a tip at the forward end of the body, a base at the rear end of the body, and a precision-machined cavity machined into the outer component. A precision-machined inner component is pressed into the cavity. The outer component includes a homogenous material that is softer than firearm barrel steel. The inner component includes a material having a higher density than the outer component and a higher density than an armor plate, such as solid tungsten, tungsten carbide and potential some Nanotechnology materials such as NanoSteel™. A cap may be attached to the outer component to seal the inner component inside the cavity. The cavity can be machined from the front or rear end of the outer component. The cap fits into the rear of the projectile or may be a bullet tip. The cavity and the inner component may be cylindrical or tapered.

20 Claims, 3 Drawing Sheets

U.S. PATENT DOCUMENTS 6,240,850 B1 * 6/2001 Holler ..... 102/439
6,286,433 B1 * 9/2001 Borg et al. ..... 102/518
6,317,946 B1 * 11/2001 Beal ..... 29/592
6,546,875 B2 * 4/2003 Vaughn et al. ..... 102/507
6,581,522 B1 * 6/2003 Julien et al. ..... 102/431
6,629,485 B2 * 10/2003 Vaughn et al. ..... 86/55
6,865,978 B2 * 3/2005 Kash ..... 89/1.15
6,973,879 B1 * 12/2005 McElroy et al. ..... 102/514
7,150,233 B1 * 12/2006 Eberhart ..... 102/516
2004/0055501 A1 * 3/2004 Hunn et al. ..... 102/501
2007/0017409 A1 * 1/2007 Mansfield et al. ..... 102/518
2007/0204758 A1 * 9/2007 Spatz et al. ..... 102/514
2007/0295197 A1 * 12/2007 Potterfield ..... 86/24

* cited by examiner

ADVANCED ARMOR-PIERCING PROJECTILE CONSTRUCTION AND METHOD

RELATED APPLICATIONS

The present invention claims priority on provisional patent application, Ser. No. 60/789,834, filed on Apr. 6, 2006, entitled "An Advanced Armor-Piercing Projectile Design" and is hereby incorporated by reference.

FIELD OF THE INVENTION

The present invention relates generally to the field of firearms projectiles and more particularly to an advanced armor-piercing projectile.

BACKGROUND OF THE INVENTION

Present armor-piercing projectiles are manufactured using a process that's been used for decades. These projectiles successfully defeated armor in the past, but are not capable of defeating modern armor except at very short ranges. In addition, these armor-piercing projectiles are heavy and inaccurate at long range. As a result, they are useful only at short ranges and add substantial weight to the heavy load already carried by a soldier or vehicle. The effectiveness of these armor-piercing projectiles is improved by using a deplete uranium core. However, the uranium increases the weight of the armor-piercing projectiles and does nothing to improve their accuracy. A number of studies suggest that increased cancers and other abnormalities seen in the first Gulf war were due to the use of depleted uranium penetrators and are becoming evident in the current conflict in Afghanistan and in Iraq. The uranium provides its improvement via its extreme mass, but improvements in the basic construction of armor-piercing projectiles have not been addressed.

Thus there exists a need for a lighter, more effective and more accurate armor-piercing projectiles.

SUMMARY OF INVENTION

An advanced armor penetrating firearm projectile includes precision-machined inner and outer components. The outer component includes a generally cylindrical body with a tip centered about the longitudinal axis of the body and tapered towards a point from a forward end of the body. A base section at the rear end of the body includes a precision-machined cavity. The cavity is machined into the outer component, and is concentric with the longitudinal axis of the body. The cavity is machined from the base toward an interior of the outer component. A precision-machined inner component is pressed into the cavity, and a precision-machined cap is attached to the base to seal the inner component inside the cavity.

DETAILED DESCRIPTION OF THE DRAWINGS

Figure 1:
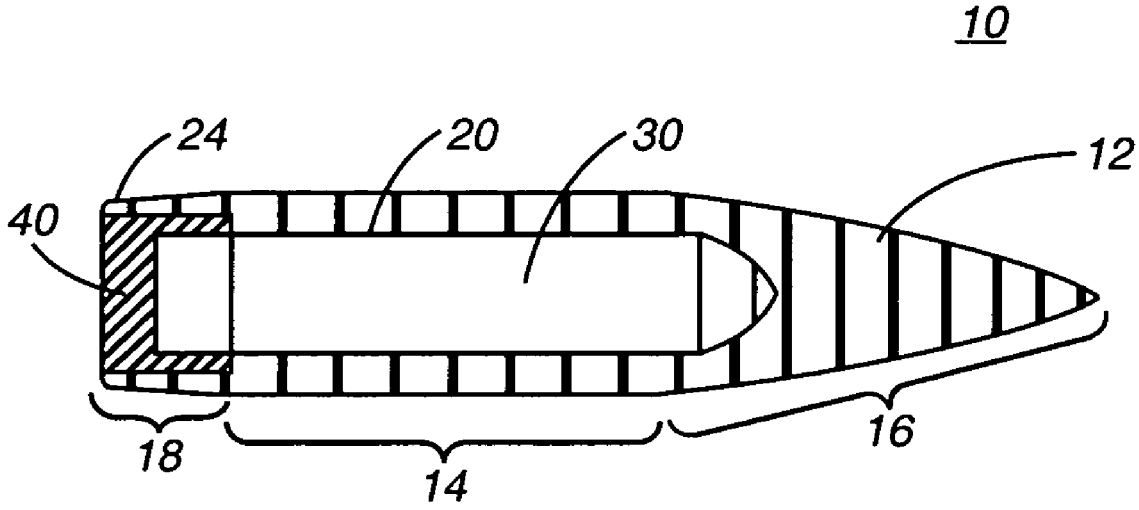
FIG. 1 is a side view of an advanced armor-piercing projectile, in accordance with the present invention.
Figure 2:
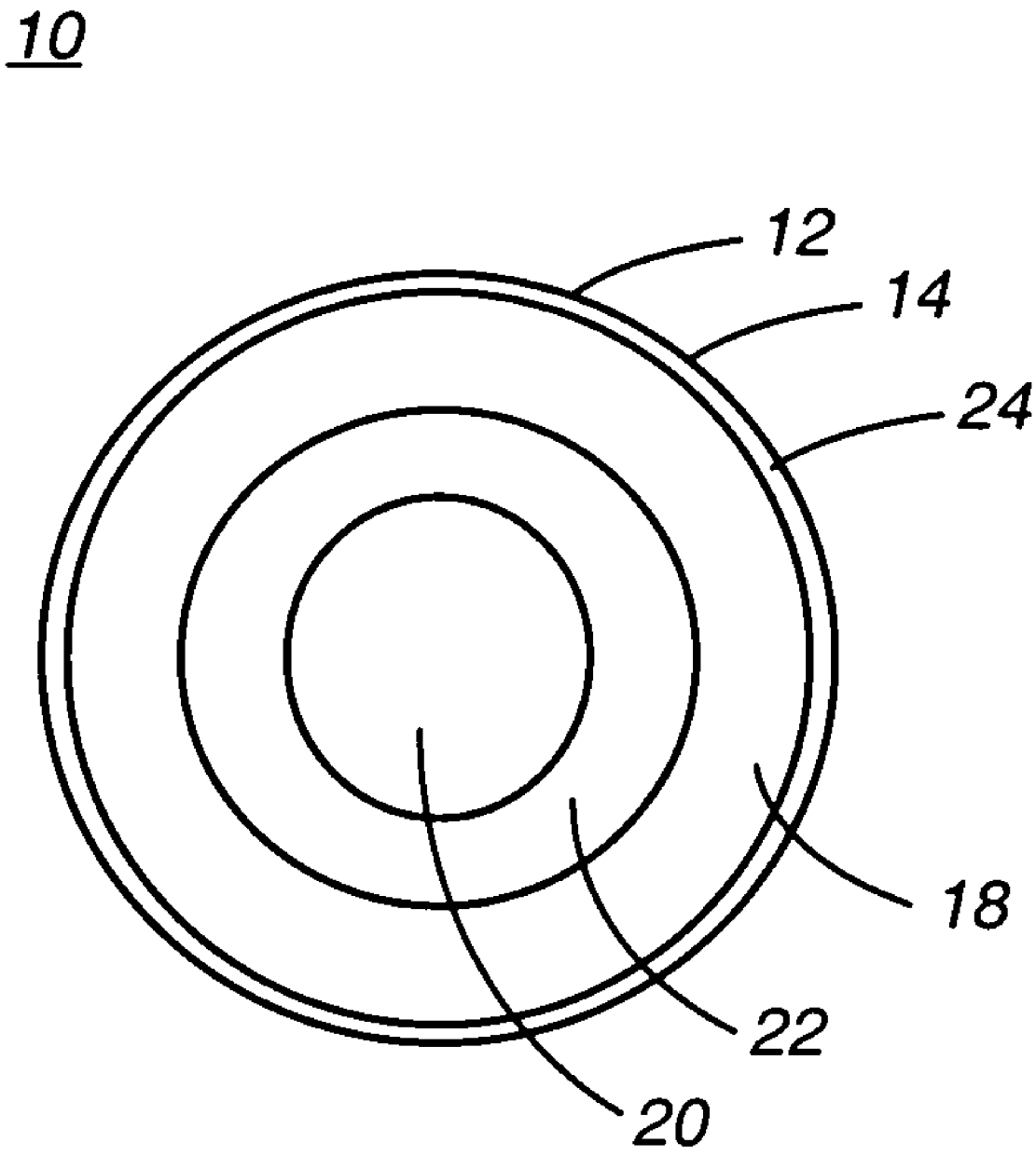
FIG. 2 is a rear view of the advanced armor-piercing projectile, in accordance with the present invention.
Figure 3:
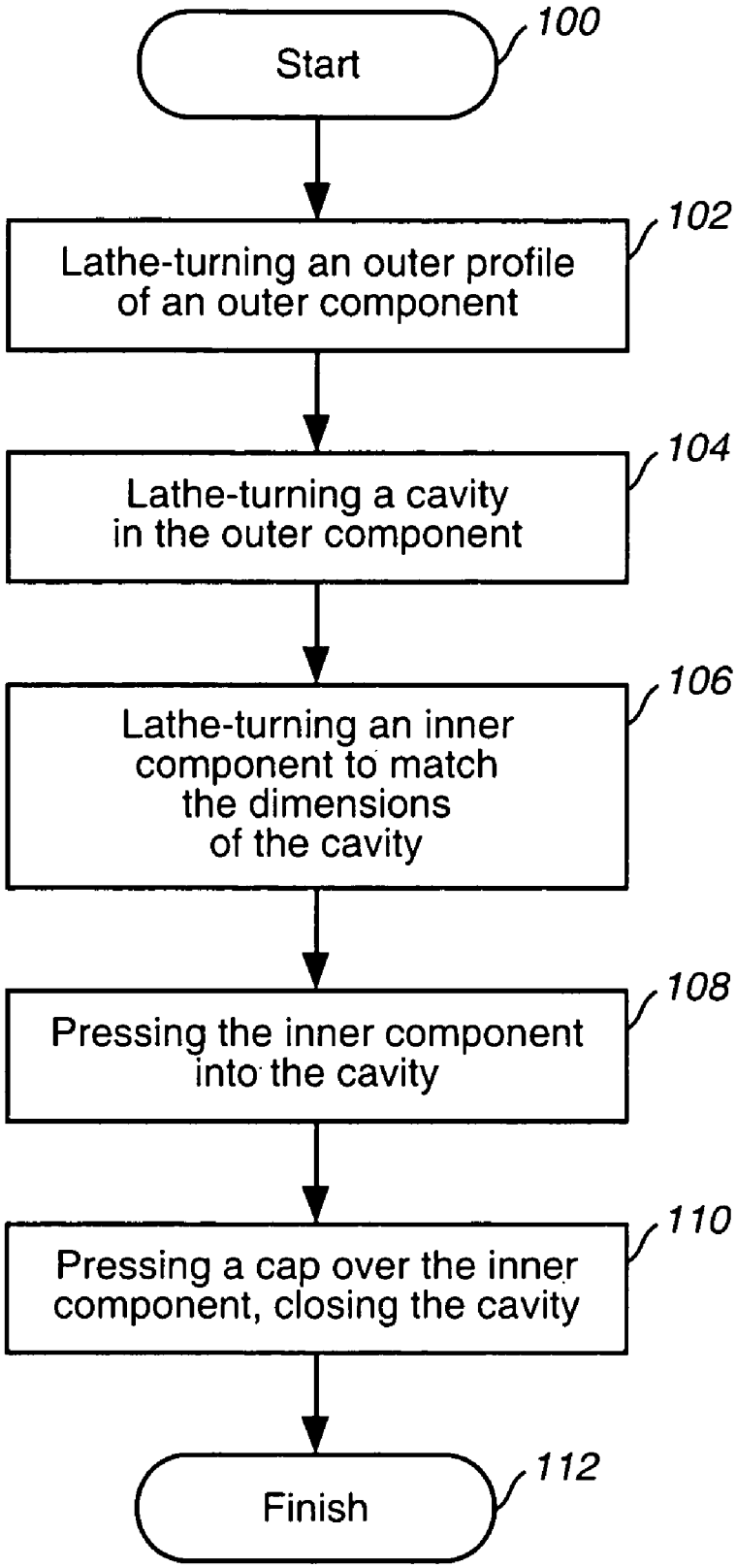
FIG. 3 is a flowchart of the steps involved in manufacturing an advanced armor-piercing projectile, in accordance with the present invention.

In summary, the invention is an advanced armor-piercing projectile for firearms. FIGS. 1 and 2 show side, and rear views of the advanced armor-piercing projectile 10. In one embodiment, the firearm projectile 10 includes a precision-machined outer component 12. The outer component 12 includes a generally cylindrical body 14, a tip 16 tapered from a forward end of the body 14, and a base 18 at a rear end of the body 14. A precision-machined cavity 20 is formed into the outer component 12. In one embodiment, the cavity 20 is machined from the base 18 toward the interior of the outer component 12. A matching precision-machined inner component 30 is pressed into the cavity 20. In one embodiment, a cap 40 is pressed into a recess 22 in the base 18 and across the inner component 30 to seal the inner component 30 inside the cavity 20. The base 18 may include a boat tail 24 for aerodynamic considerations. The precision-machining process may be accomplished with a precision lathe, a drill, or other high-precision equipment.

In another embodiment, a precision-machined cavity 20 is machined into the front of the outer component 12. As above, the cavity 20 is machined toward the interior of the outer component 12. There are several different ways to insert the inner component 30 into such an outer component 12. A first way involves pressing the precision-machined inner component 30 into the cavity 20 in the outer component 12. A precision-machined tip component is then pressed into the cavity 20 atop the inner component 30 to seal the inner component 30 inside the cavity 20. A second way involves pressing the precision-machined inner component 30 into a separate cavity in the precision-machined tip component. This subassembly is then pressed into the cavity 20 in the outer component 12.

The cavity 20 can be formed as a perfectly cylindrical void in the outer component 12, with the inner component machined to match. Alternatively, the cavity 20 may be tapered slightly, such as a truncated conical shape, with a matching inner component 30. The taper need not be significant. A taper of only a couple thousandths of an inch over the length of the inner component 30 or the depth of the cavity 20 is sufficient. Properly formed, the tapered shape of the inner component 30 will not act as a wedge to force the cavity 20 open because the inner component will bottom-out in the cavity 20 before that can happen. Of course, as described above, this type of precision machining is already required in manufacturing projectiles of this type.

The outer component 12 is a homogenous material that is softer than the firearm barrel from which it is fired. Thus, the outer component 12 is capable of being engraving by barrel's rifling. Suitable materials for the outer component 12 include copper, copper alloys, and other similar materials.

The inner component 30 is a material that has a higher density than the outer component and is hard enough to enable penetration and perforation of armor. In one embodiment the inner component 30 is made from a material having a higher density than an armor plate. Suitable materials for the inner component include solid tungsten, tungsten carbide and potentially some nanotechnology materials such as NonoSteel™, etc. In another embodiment, the inner component 30 and outer component 12 are non-toxic.

In one embodiment, the body 14 of the firearm projectile 10 has a diameter of between about 5 mm and 40 mm. Thus, the advanced armor penetrator is quite useful in small arms applications.

A method of manufacturing a firearm projectile 10 begins, step 100 by lathe-turning an outer profile of an outer component 12, step 102. Next, step 104, a cavity 20 is lathe-turned in the outer component 12, and an inner component 30 is lathe-turned to match the dimensions of the cavity 20, step 106. Next, the inner component 30 is pressed into the cavity 20, step 108. Finally, step 110, a cap is pressed over the inner component 30, closing the cavity 20, which finishes the process, step 112.

The cavity 20 is turned in the outer component 12 is concentric with the rotation axis of the outer component 12. In one embodiment, the cavity 20 is turned to no more than 0.001 inches from perfect concentricity with the outer component 12. In another embodiment, the cavity 20 is turned to no more than 0.0005 inches from perfect concentricity with the outer component 12. It is important that any irregularities, including air spaces between the inner component 30 and the outer component 12 are eliminated. The extreme precision required is why the components are machined as a primary method of forming the inner component 30 and the outer component 12. In another embodiment, the assembled projectile 10 is processed through a pressure die. However, the object here is not to form the bullet 10 to its final dimensions so much as to remove any external irregularities that may have been introduced during assembly.

Application of the Projectile

The projectile is composed of two solid metals or metal alloys with the outer component 12 soft enough to engrave on the barrel's rifling and the inner component 30, or penetrator, which is harder than the intended armor target. One theory to explain this bullet's effectiveness is that the outer component 12 concentrates its kinetic energy at the point of contact with the target while the outer component 12 itself is turned into an imperfect fluid. As it turns into an imperfect fluid, it penetrates the armor target to some degree and acts to shield the inner component 30 for a short time. The short delay permits the inner component 30 (penetrator) a running start to try to perforate the target before the inner component 30 turns into an imperfect fluid. At the time the projectile 10 impacts the target, if the penetrator 30 has adequate velocity and remains in its solid state long enough, the penetrator 30 will continue to penetrate the target until the target is completely perforated. Such a projectile 10 can be used alone or encased in a sabot for superior armor penetration and perforation.

The precision manufacturing process insures that the gyroscopic stability of the projectile during flight remains optimal. This stability has two effects: first, the projectile will behave in a very predictable manner over a very long distance, well over a mile, and will not deviate from its original trajectory except due to wind, gravity and Coriolis Effect; and second, a stable projectile impacts a target in a predictable and repeatable manner, resulting in more uniform terminal ballistics properties. Ultimately, this stability provides heretofore unknown levels of confidence for military planners and marksmen. Of course the projectile must be imparted with the proper spin rate from a barrel having the proper twist rate.

Experimental evidence supports these conclusions. Experimental evidence resulted from testing this projectile design in the .408 CheyTac® cartridge as a model armor-piercing cartridge. Projectile impacts upon armor targets were observed to study the effect of the hardened outer solid 12 and inner core 30 (penetrator) on the armor target. For the .408 CheyTac® armor-piercing projectile, the outer solid 12 is a copper nickel alloy and the inner core 30 (penetrator) is tungsten carbide.

The performance provided by this projectile is the best ever seen against a 1-inch WearAlloy 550 armor steel plate at 100 yards. The projectile fired from the .408 CheyTac cartridge defeated this armor. As a control, .50-caliber BMG (Browning Machine Gun) armor-piercing cartridges (both black and silver tips) were used against identical armor plates. Even though the .50 BMG armor-piercing projectile weighs approximately twice that of the .408 CheyTac® armor-piercing projectile and has a similar muzzle velocity, it failed to perforate the 1-inch WearAlloy 550 armor steel plate.

A second example is seen with 1-inch Allegheny Technology WAH CHANG 425 armor titanium plate, made for armor vehicles. The .408 CheyTac® armor-piercing projectile perforates these armor plates out to 300 yards, while exhibiting accuracy of one minute of angle (MOA) or better. The .50 BMG armor-piercing projectile (black tip) was unable to perforate these armor plates beyond 50 yards.

Thus, even though the .50 BMG armor-piercing projectile delivers more kinetic energy to the armor steel than the .408 CheyTac® armor-piercing projectile, it fails to perforate. The logical conclusion is that the .408 CheyTac® armor-piercing projectile has a superior design allowing to perforate the armor with less kinetic energy. A further conclusion is that the .408 CheyTac projectile concentrates its available kinetic energy at the point of impact, due to its construction, while the .50 BMG armor-piercing projectile dissipates some of its kinetic energy away from the point of impact, due to its construction.

Further evidence is available regarding the stability of the projectile used in the .408 CheyTac® cartridge. The projectile exhibits sub-MOA performance out to 600 yards. This means that all fired projectiles impact the target within a circle 6 inches or smaller at 600 yards. Beyond 600 yards, up to 1000 yards, the projectile exhibits sub-2 MOA performance, or within a circle 20 inches or smaller at 1000 yards.

It is known that the successful perforation by any armor-piercing projectile is dependent on the thickness of the armor and velocity of the projectile at impact. The invention described here is shown to be more successful and effective than currently-available armor-piercing projectiles in a larger caliber having more kinetic energy. Experimental data supports the concept of a superior design that focuses available kinetic energy at the point of impact versus dispersion of the kinetic energy away from the point of impact.

If the projectile were used in a SLAP (Saboted Light Armor Piercing) configuration, the velocity would be greater than when used in a non-saboted configuration. This would result in greater penetration over armor-piercing projectiles currently used in SLAP cartridges.

While the invention has been described in conjunction with specific embodiments thereof, it is evident that many alterations, modifications, and variations will be apparent to those skilled in the art in light of the foregoing description. Accordingly, it is intended to embrace all such alterations, modifications, and variations in the appended claims.

What is claimed is:

1. A firearm projectile, comprising:

a precision machined outer component, the outer component comprising a generally cylindrical body, a tip tapered from a forward end of the body, a base at a rear end of the body, and a precision-machined cavity machined into the outer component, wherein the cavity is perfectly concentric to within 0.001 inches with the rotation axis of the outer component; and a precision-machined inner component pressed into the cavity, wherein the projectile has a single piece core, the projectile fired from a .408 cartridge capable of perforating a 1-inch WearAlloy 550 armor steel elate at 100 yards.

2. The firearm projectile of claim 1, where the outer component further comprises:

a homogenous material that is softer than firearm barrel steel and strong enough to withstand the stresses of firing.

3. The firearm projectile of claim 2, where the inner component further comprises:

a material having a higher density than the outer component.

4. The firearm projectile of claim 3, where the inner component further comprises a material having a higher density than an armor plate.

5. The firearm projectile of claim 3, where the inner component comprises solid tungsten.

6. The firearm projectile of claim 3, where the inner component comprises tungsten carbide.

7. The firearm projectile of claim 1, further comprising:

a cap attached to the outer component to seal the inner component inside the cavity.

8. The firearm projectile of claim 1, where the cavity is machined into the base end of the outer component toward an interior of the outer component.

9. The firearm projectile of claim 1, where the cavity and the inner component each comprise a cylinder.

10. The firearm projectile of claim 1, where the cavity and the inner component comprise truncated cones.

11. An armor-penetrating firearm projectile, comprising:

a precision machined outer component, the outer component comprising a generally cylindrical body, a tip tapered from a forward end of the body, a base at a rear end of the body, and a precision-machined cavity machined into the outer component, and further comprising a homogenous material that is softer than firearm barrel steel and strong enough to withstand the stresses of firing, wherein the cavity is perfectly concentric to within 0.001 inches with the rotation axis of the outer component; and a precision-machined inner component pressed into the cavity, the inner component comprising a material having a higher density than the outer component and a higher density than a targeted armor plate, wherein the projectile has a single piece core the projectile fired from a .408 cartridge capable of perforating a 1-inch WearAlloy 550 armor steel plate at 100 yards.

12. The firearm projectile of claim 11, further comprising:

a cap attached to the cavity in the outer component to seal the inner component inside the cavity.

13. The firearm projectile of claim 11, where the inner component comprises tungsten.

14. The firearm projectile of claim 11, where the cavity and the inner component each comprise a cylinder.

15. An armor-penetrating firearm projectile, comprising:

a precision machined homogenous solid metal outer component having a body and a tip;

a precision machined cavity in the body, wherein the cavity is perfectly concentric to within 0.001 inches with the rotation axis of the outer component;

an inner component having a shape that matched the cavity;

a cap fitting into an end of the body, wherein the design of the outer component, inner component and cap ensure gyroscopic stability of the projectile during flight, wherein the projectile has a single piece core the projectile fired from a .408 cartridge capable of perforating a 1-inch WearAlloy 550 armor steel plate at 100 yards.

16. The firearm projectile of claim 15, where the outer component further comprises:

a homogenous material that is softer than firearm barrel steel and strong enough to withstand the stresses of firing.

17. The firearm projectile of claim 16, where the inner component further comprises:

a material having a higher density than the outer component.

18. The firearm projectile of claim 17, where the inner component further comprises a material having a higher density than an armor plate.

19. The firearm projectile of claim 15, wherein the projectile has less than two minute of angle accuracy at 1000 yards.

20. The firearm projectile of claim 15, where the projectile has one minute of angle accuracy at 300 yards.

* * * * *